US005823887A

United States Patent [19]

Mikame et al.

[11] Patent Number: 5,823,887

[45] Date of Patent: Oct. 20, 1998

[54] IRON GOLF CLUB SET

[75] Inventors: Daisuke Mikame; Masaomi Hiruta; Hirato Shimasaki; Hiroshi Ezaki, all of Saitama-ken, Japan

[73] Assignee: Bridgestone Sports Co., Ltd., Tokyo, Japan

[21] Appl. No.: 712,095

[22] Filed: Sep. 11, 1996

[30] Foreign Application Priority Data

Sep. 11, 1995 [JP] Japan ..... 7-258092

[51] Int. Cl.[6] ..... A63B 53/04

[52] U.S. Cl. ..... 473/290; 473/291; 473/314; 473/350

[58] Field of Search ..... 473/287, 290, 473/291, 341, 349, 314, 350

[56] References Cited

U.S. PATENT DOCUMENTS

| | | | |
|---|---|---|---|
| 4,848,747 | 7/1989 | Fujimura | 473/291 |
| 5,295,686 | 3/1994 | Lundberg | 473/291 |
| 5,312,105 | 5/1994 | Cleveland | 473/350 |
| 5,607,363 | 3/1997 | Chou | 473/290 |
| 5,616,086 | 4/1997 | Chappell | 473/290 |
| 5,629,475 | 5/1997 | Chastonay | 473/292 |

*Primary Examiner*—Sebastiano Passaniti
*Assistant Examiner*—Stephen L. Blau
*Attorney, Agent, or Firm*—Jordan and Hamburg

[57] ABSTRACT

A set of iron golf clubs permitting to hit a ball correctly with a positive ball catching and less pulling even when used by any average golfer, in which as the club number ascends, the center distance L between the axis 20 of club shaft and the center C of club head impact face 2 is gradually longer and the weight distributed on the heel 4 is gradually smaller while the weight distributed on the toe 3 is gradually larger.

9 Claims, 8 Drawing Sheets

IRON GOLF CLUB SET

BACKGROUND OF THE INVENTION

1. Field of the Invention

The present invention relates to a set of iron golf clubs.

2. Description of the Prior Art

Each of commercially available iron golf club sets usually is a set of 9 clubs: Nos. 3 to 9 irons, a pitching wedge and sand iron, or a set of 10 clubs: Nos. 3 to 9 irons, a pitching wedge, sand iron and a third wedge (called "pitching sand iron", "approach wedge" or "lob shot wedge"). Also, Nos. 1 and 2 ion clubs are available but optionally. The pitching wedge, sand iron and pitching sand iron are also called Nos. 9, 10 and 11, respectively. Among these iron clubs, the iron club of the smallest number has the longest shaft and smallest loft angle to provide a longer distance of ball flight. As the club number ascends, the club shaft is shorter and loft angle is larger. Recently, increasingly more and more iron golf clubs have a so-called cavity back type head. The cavity back type iron head has a back face wall thinned about the center and a perimeter weight increased to lower the gravity for a higher ball flight and widen the sweet area for a more positive ball hitting. More recently, such cavity-back type iron clubs include those having a cavity gradually changed as the club number descends. This type of cavity is called "gradational cavity".

The larger head and cavity back structure assure a more stable direction, and a longer distance, of ball flight even if a ball is struck at a somewhat wrong place on the club face during impact. However, the small-numbered iron clubs are still difficult to use for so-called "average golf players". When a small-numbered iron, a so-called "long iron", is used by any average golfer, the club head face cannot successfully be turned adequately to the left (right for the lefty golfers) after impact. Namely, a ball will be struck on what we call "open face", which is likely to result in a slice or push-out. It is difficult for average golf players to hit a ball correctly with small-numbered irons. On the contrary, when a large-numbered iron club or "short iron" is used by an average golfer, the head face is easily turned to the left, that is, a ball will be struck on what we call "closed face", which is likely to result in a pull.

SUMMARY OF THE PRESENT INVENTION

Accordingly, the present invention has an object to overcome the above-mentioned drawbacks of the conventional iron golf club heads by providing a set of iron golf clubs which permits a user to hit a ball correctly with a positive ball engagement and less pulling even when used by any average golfer.

The above object of the present invention is accomplished by providing a set of iron golf clubs, in which as the club number ascends, the center distance between the axis of club shaft and the center of club head impact face is gradually longer and the weight distributed on the heel side is gradually smaller while the weight distributed on the toe side is gradually larger.

According to another aspect of the present invention, a set of golf club heads is provided, in which each club head has a cavity formed in the back face thereof, the cavity perimeter is surrounded by a rib, and as the club number ascends, the toe-side rib width is gradually larger while the heel-side rib width is gradually smaller.

These and other objects and advantages of the present invention will be better understood from the ensuing description made, by way of example, of the preferred embodiments of the present invention with reference to the drawings.

DETAILED DESCRIPTION OF THE PREFERRED EMBODIMENTS

Figure 1:
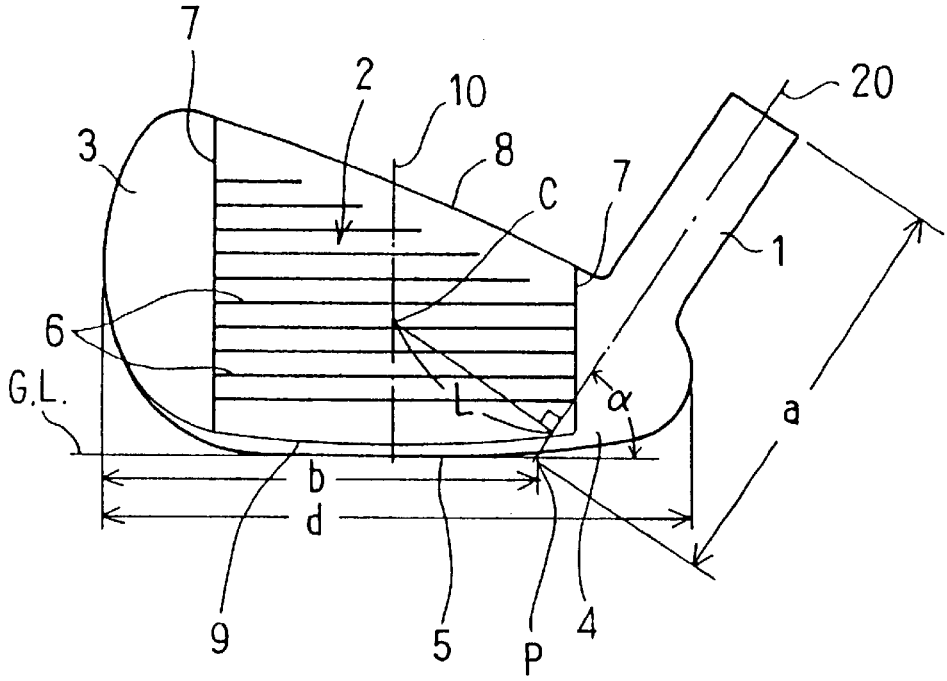
FIG. 1 is a front view of a No. 1 iron club head according to the present invention.

FIG. 1 shows a front view of the No. 1 iron club head according to the present invention (the club head is viewed from a direction perpendicular to the impact face of the club head). The club head has a hosel 1 to which a club shaft (not shown) is to be connected. The head has an impact face 2 under the hosel 1, and also a toe 3, heel 4 and sole 5. The club head has score lines 6 formed in the impact face 2 and a vertical line 7 formed in each of the toe 3 and heel 4. The club head has a top edge 8 and leading edge 9. Namely, the impact face 2 is defined by the vertical lines 7, top edge 8 and leading edge 9 as illustrated.

Here, the vertical line bisecting a distance between the vertical lines 7 is assumed to be the center line 10 of the impact face. The mid point of a distance between the top edge 8 and leading edge 9 and lying on the center line 10 is assumed to be the center C of the impact face 2. The length of a perpendicular line from the center C of the impact face 2 to the axis 20 of the club shaft is assumed to be L (center distance). According to the present invention, the No. 1 iron is designed to have a lie angle $\alpha$ of 56°. The length of the shaft axis 20 from the top end of the hosel 1 to the intersection P with a ground line G–L is assumed to be a. The length from the intersection P of the axis 20 with the ground line GL to the outermost end of the toe 3 is assumed to be b. The total horizontal length of the club head front face is assumed to be d. These dimensions a, b and d are designed to be 68.0, 72.0 and 97.0 mm, respectively, for this No. 1 iron according to the present invention.

Figure 2:
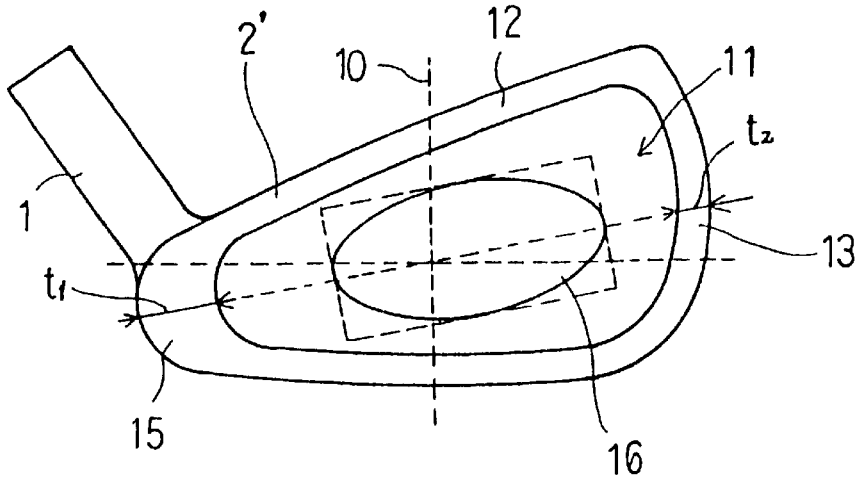
FIG. 2 is a rear view of the No. 1 iron club head in FIG. 1.

FIG. 2 shows the rear side of the No. 1 iron illustrated in FIG. 1. As shown, the club head No. 1 has a back face generally indicated with a reference numeral 2', which has a cavity 11 formed therein about the central area thereof and ribbed as indicated with 12 to 15. The rib 15 at the heel 4 has a width $t_1$, and the rib 13 at the toe 3 has a width $t_2$. This No. 1 iron is designed to have a rib width $t_1$ of 13 mm and $t_2$ of 5 mm. The back face 2' has a hard plate 16 secured with a pressure-sensitive adhesive double coated tape or an adhesive in the cavity 11.

Figure 3:
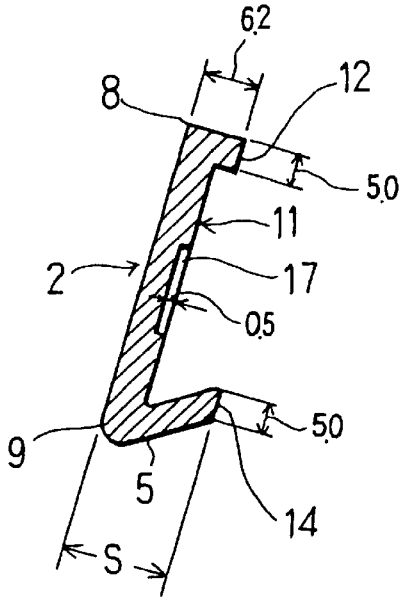
FIG. 3 is a sectional end view of the No. 1 iron club head taken along the center line of the club head.

FIG. 3 is a sectional end view of the No. 1 club head taken along the center line 10. The back face has also a recess 17 formed therein and in which the plate 16 is received for attachment. The sole 5 has a width S of 17.5 mm at a point thereof intersected by the center line 10. The iron Nos. 1 to 7 are designed to have a same sole width S, and the No. 8 iron has a sole width of 16.9 mm.

According to the present invention, the iron club heads are designed to have a center distance L which is gradually longer as the club number ascends. The typical center distances L for the club Nos. from 1 to 9 in a set are shown in Table 1.

TABLE 1

| | L | | | | | | | | |
|---|---|---|---|---|---|---|---|---|---|
| Club No. | 1 | 2 | 3 | 4 | 5 | 6 | 7 | 8 | 9 |
| Center distance (mm) | 33.0 | 33.4 | 34.6 | 35.5 | 36.9 | 37.2 | 37.8 | 38.7 | 40.0 |
| Distance between head gravity and shaft axis (mm) | 29.86 | 30.12 | 31.54 | 32.54 | 33.64 | 34.47 | 34.91 | 35.95 | 36.76 |

In the iron golf clubs according to the present invention, the distance (not shown) between the center of gravity of the club head (not shown) and the shaft axis 20 (length of a perpendicular line from the center of gravity to the axis 20) is also longer as the club number ascends as shown in Table 1. In each iron club head, the center distance L on the impact face 2 is larger by only about 3 mm than the distance between the club head gravity and shaft axis 20. The center C of the impact face 2 therefore substantially corresponds to the position of the center of gravity club head on the impact face 2. Along with the change in the center distance L, the center of gravity of each club head is made to flow by changing the width $t_2$ of the rib 15 at the toe 3 and that $t_1$ of the rib 13 at the heel 4 around the cavity 11 as having been described above. The desired distance between the head center of gravity and shaft axis 20 of each iron is as shown below.

| | |
|---|---|
| No. 1 | 29.5 ± 1.5 mm |
| No. 2 | 30.6 ± 1.5 mm |
| No. 3 | 31.6 ± 1.5 mm |
| No. 4 | 32.6 ± 1.5 mm |
| No. 5 | 33.6 ± 1.5 mm |
| No. 6 | 34.5 ± 1.5 mm |
| No. 7 | 35.2 ± 1.5 mm |
| No. 8 | 35.7 ± 1.5 mm |
| No. 9 | 36.2 ± 1.5 mm |

For the pitching wedge, pitching sand iron and sand iron, the distance L should preferably be set on the order of 36.6±1.5 mm.

As having been described in the foregoing, the difference in the distance L between a long iron and a next-numbered long iron should preferably be set a little larger than ever.

Also, the weight at the heel 4 is designed to be gradually smaller while the weight at the toe 3 is gradually larger, as the club number ascends. The weight distribution at the toe 3 and heel 4 should be set depending upon the relation between the width $t_1$ of the rib 15 and the width $t_2$ of the rib 13 shown by way of example in Table 2.

TABLE 2

| Club No. | | 1 | 2 | 3 | 4 | 5 | 6 | 7 | 8 | 9 |
|---|---|---|---|---|---|---|---|---|---|---|
| Rib width | $t_1$ | 13 | 12 | 11 | 10 | 9 | 8 | 7 | 6 | 5 |
| | $t_2$ | 5 | 6 | 7 | 8 | 9 | 10 | 11 | 12 | 13 |

The dimensions b and d shown in FIG. 1 are 72.0 mm and 97.0 mm, respectively, for the No. 1 iron club. They are 76.0 mm and 97.0 mm, respectively, for the No. 5 iron club, and 80.0 mm and 97.0 mm, respectively, for the No. 9 iron club.

The plate 16 is made of aluminum, and the pressure-sensitive adhesive double coated tape used to securely attach the plate 16 on the back face of the club head should preferably a urethane foam having an acrylic adhesive layer on both sides thereof (SUMITOMO 3M 4920).

Figure 4:
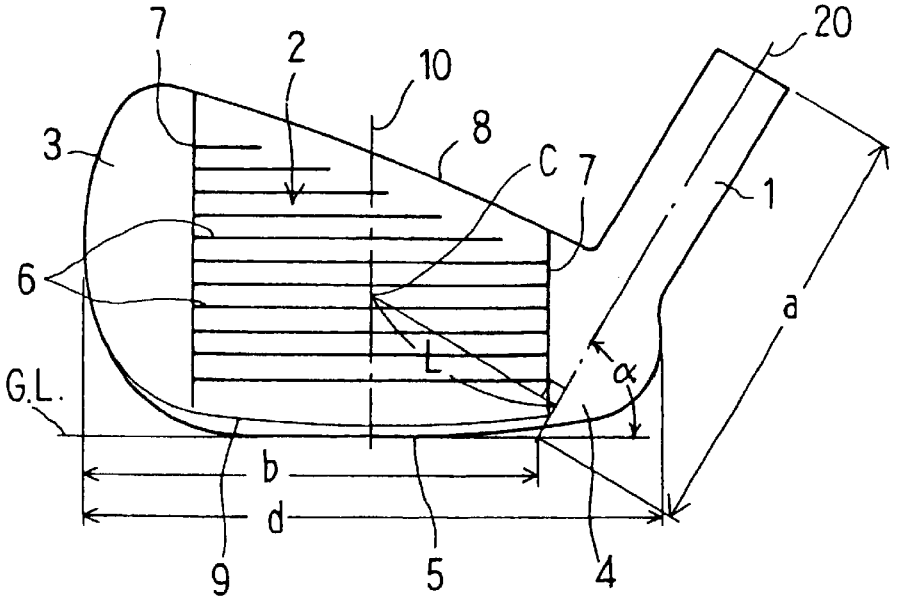
FIG. 4 is a front view of a No. 5 iron club head according to the present invention.

FIG. 4 is a front view of the No. 5 iron club head according to the present invention, in which the length a is 72.0 mm, b is 76.0 mm, d is 97.0 mm and lie angle $\alpha$ is 60°.

Figure 5:
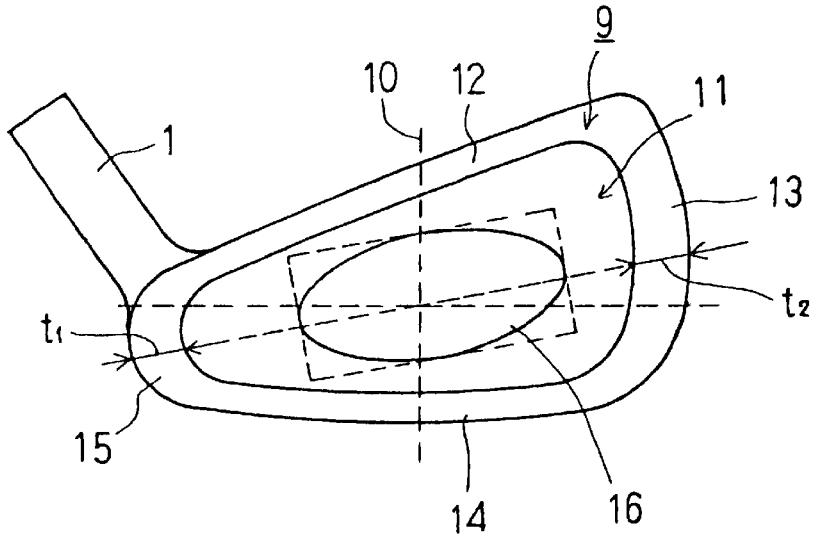
FIG. 5 is a rear view of the No. 5 iron club head in FIG. 3.

FIG. 5 is a rear view of the No. 5 iron club head, in which the rib width $t_2$ is larger than that for the No. 1 iron and $t_1$ is smaller than that for the No. 1 iron.

Figure 6:
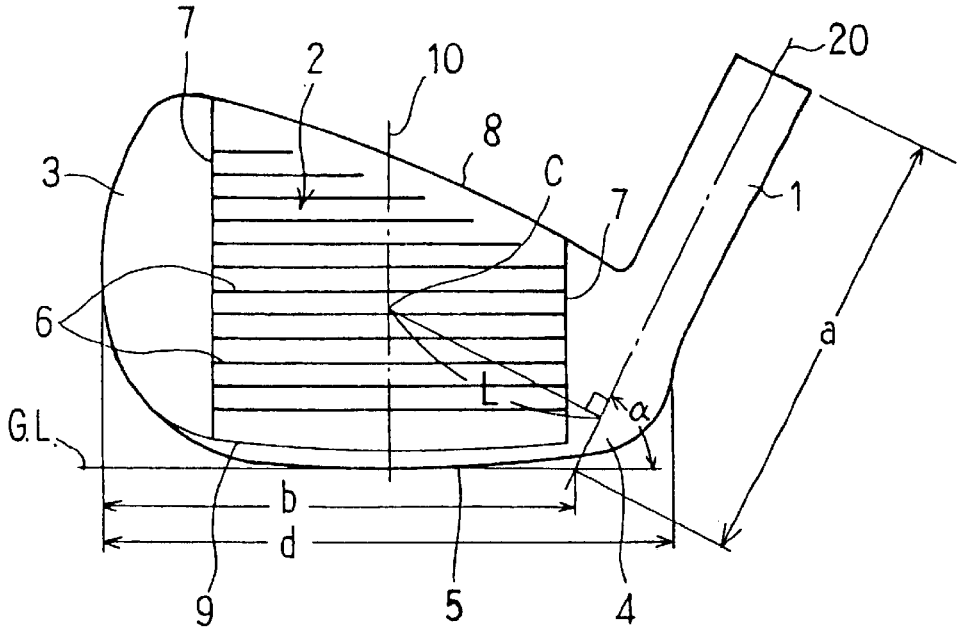
FIG. 6 is a front view of a No. 9 iron club head according to the present invention.

FIG. 6 is a front view of the No. 9 iron club head according to the present invention, in which the length a is 76.0 mm, b is 80.0 mm, and d is 97.0 mm.

Figure 7:
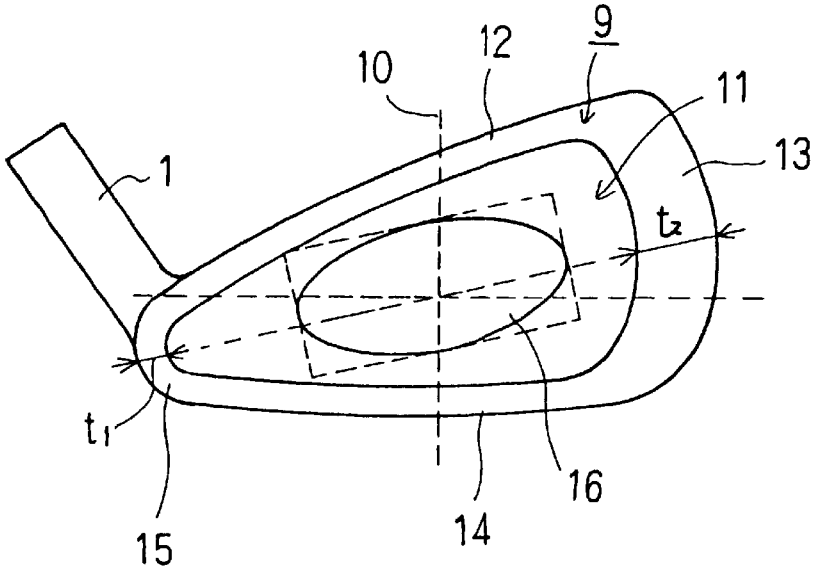
FIG. 7 is a rear view of the No. 9 iron club head in FIG. 6.
Figure 8:
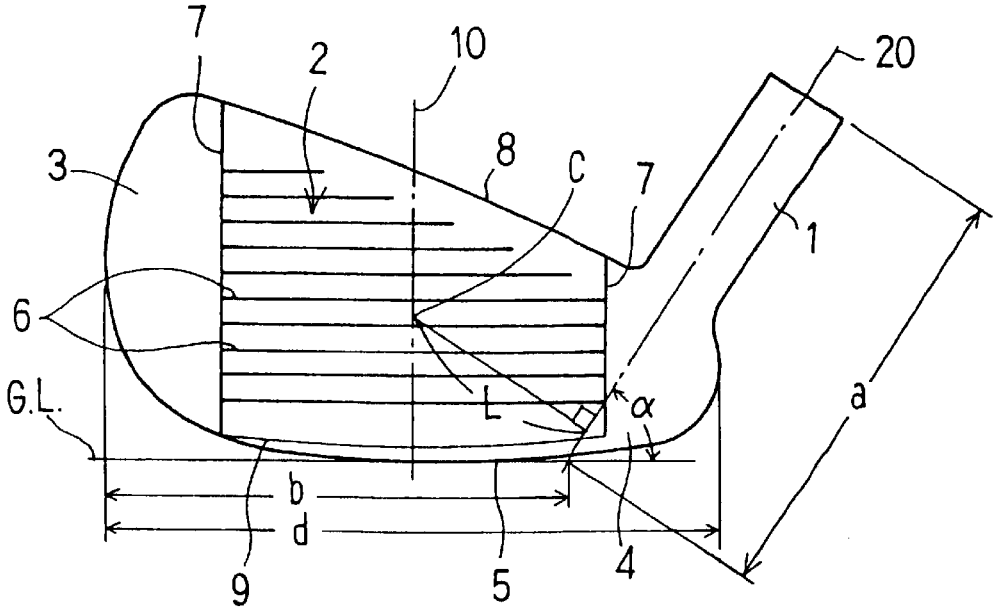
FIG. 8 is a front view of a No. 2 iron club head according to the present invention.
Figure 9:
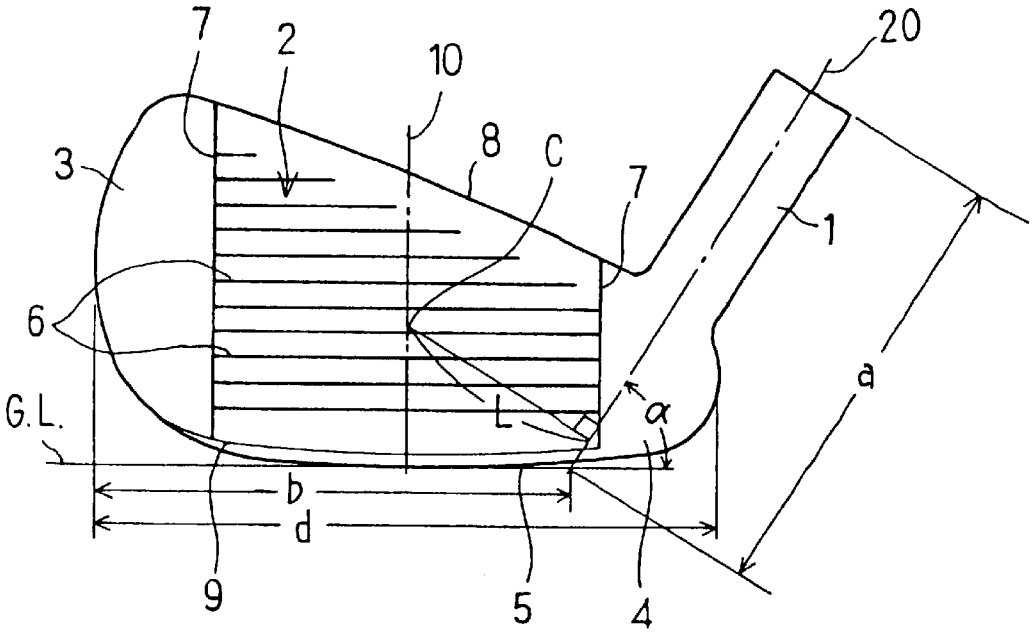
FIG. 9 is a front view of a No. 3 iron club head according to the present invention.
Figure 10:
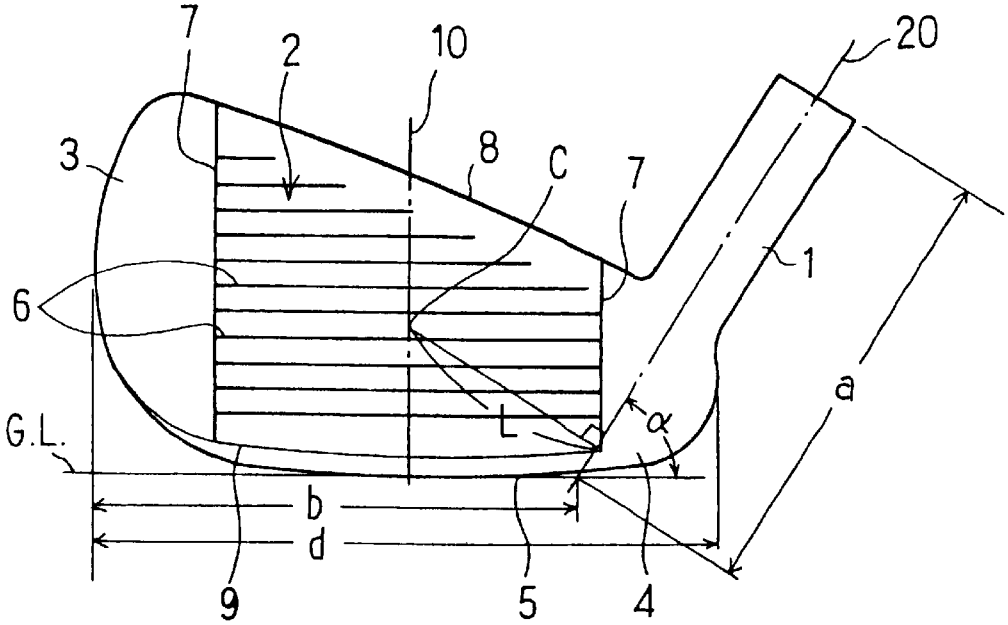
FIG. 10 is a front view of a No. 4 iron club head according to the present invention.
Figure 11:
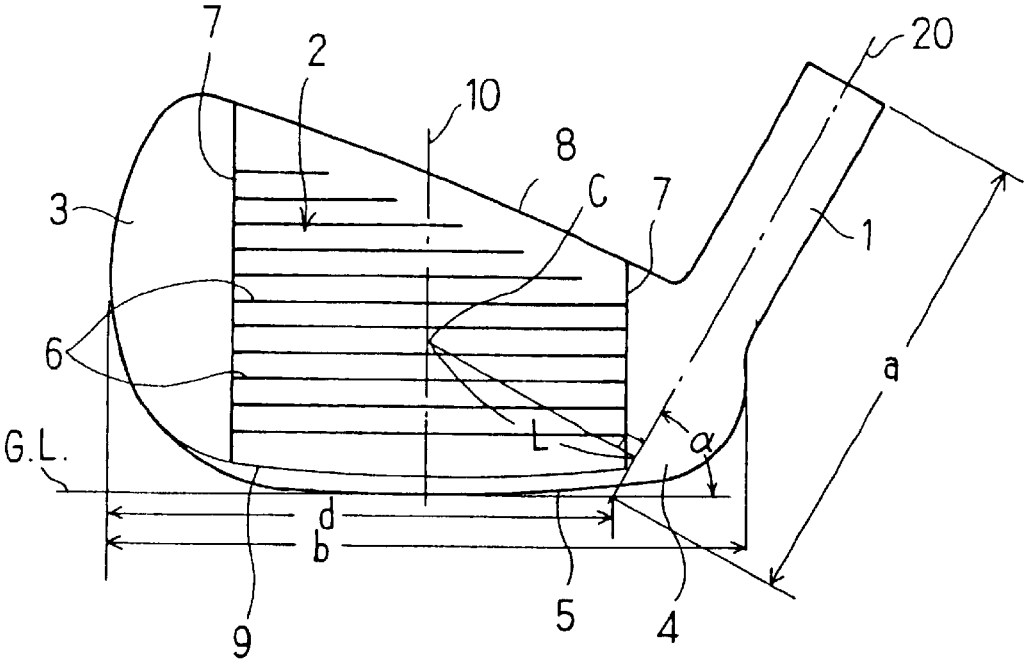
FIG. 11 is a front view of a No. 6 iron club head according to the present invention.
Figure 12:
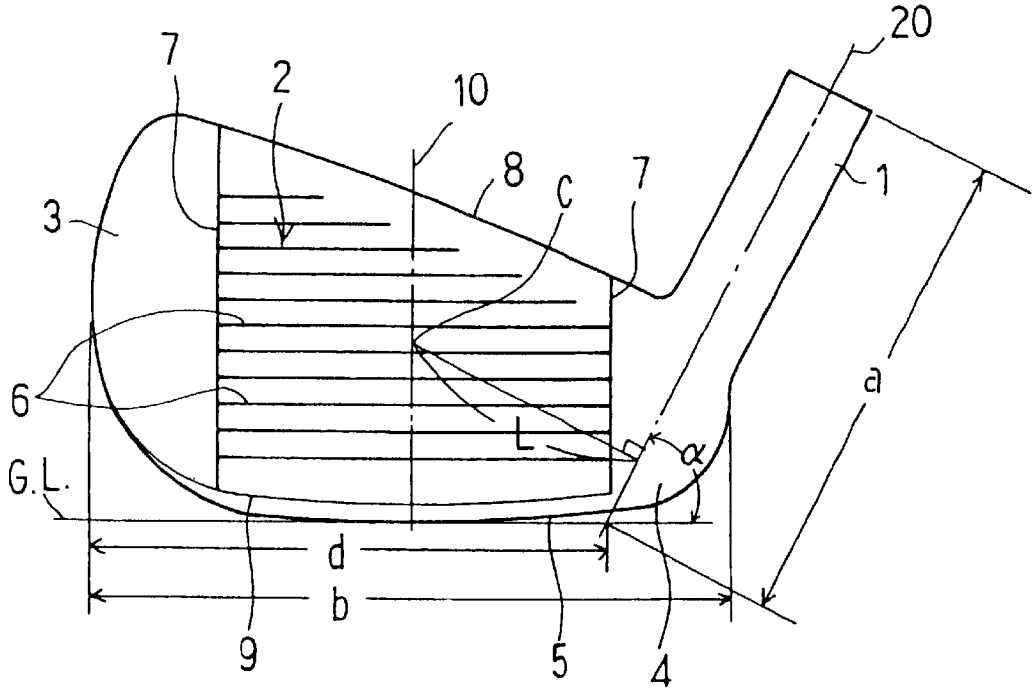
FIG. 12 is a front view of a No. 7 iron club head according to the present invention.
Figure 13:
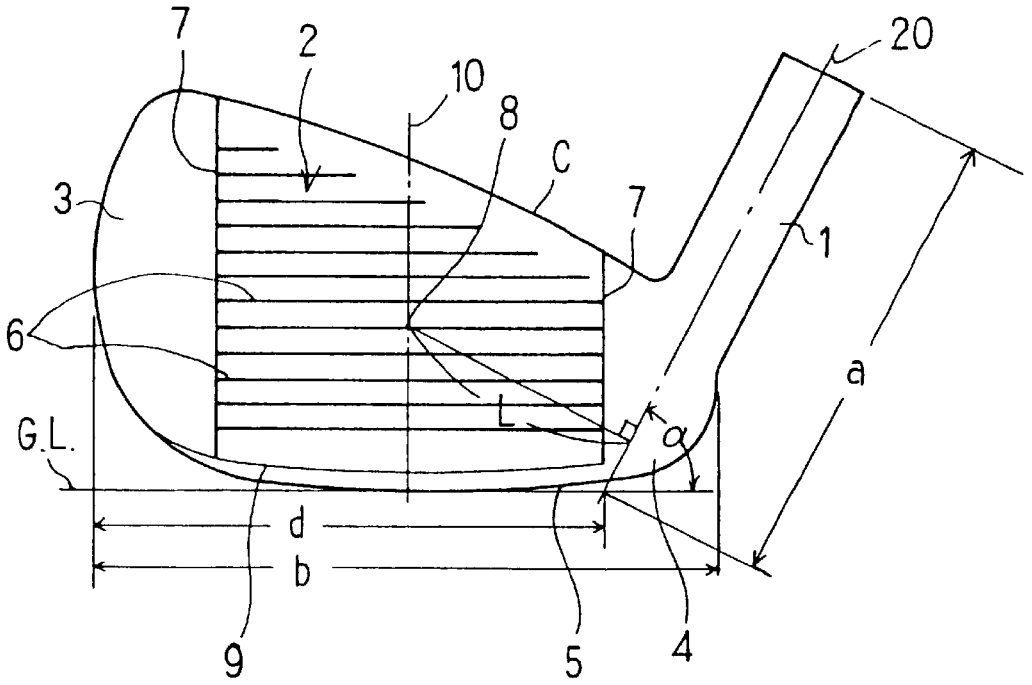
FIG. 13 is a front view of a No. 8 iron club head according to the present invention.
Figure 14:
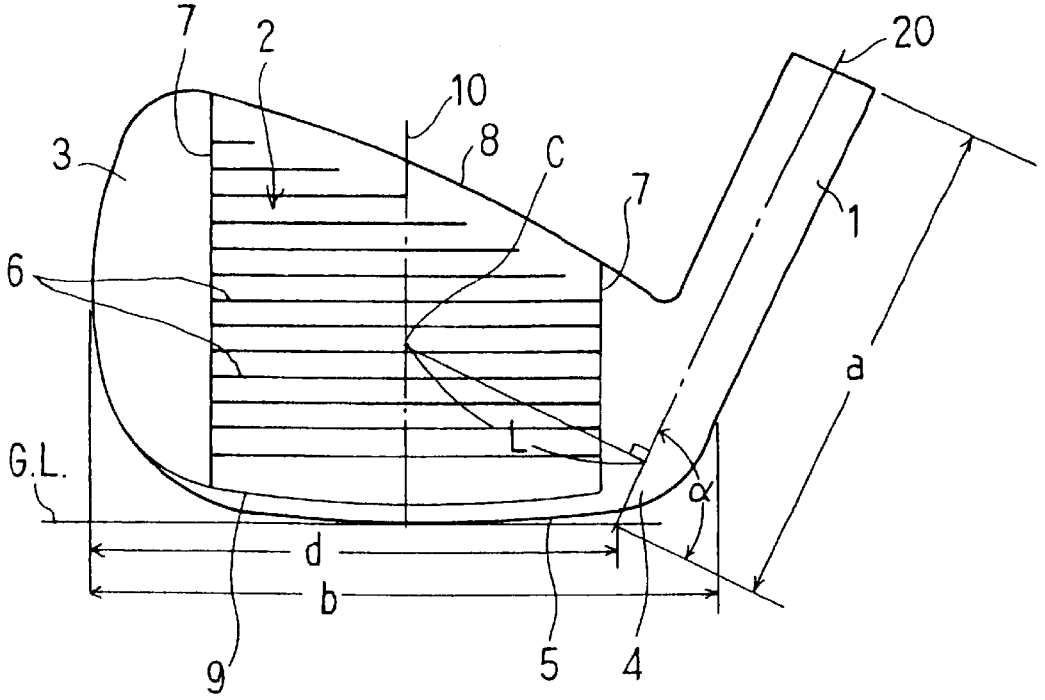
FIG. 14 is a front view of a pitching wedge club head according to the present invention.
Figure 15:
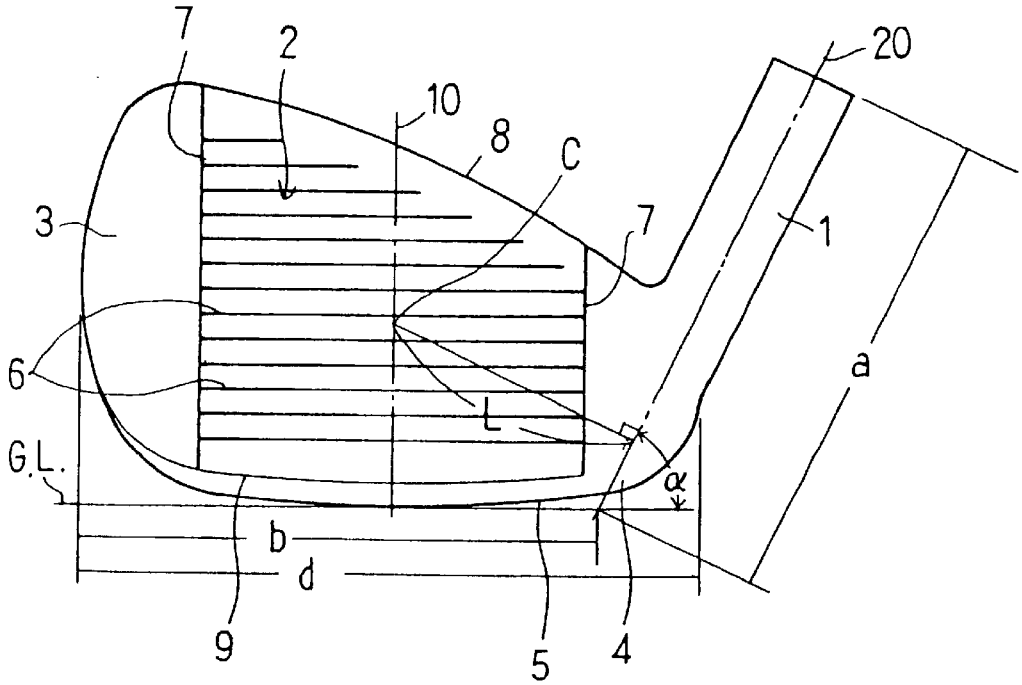
FIG. 15 is a front view of a pitching sand iron club head according to the present invention.
Figure 16:
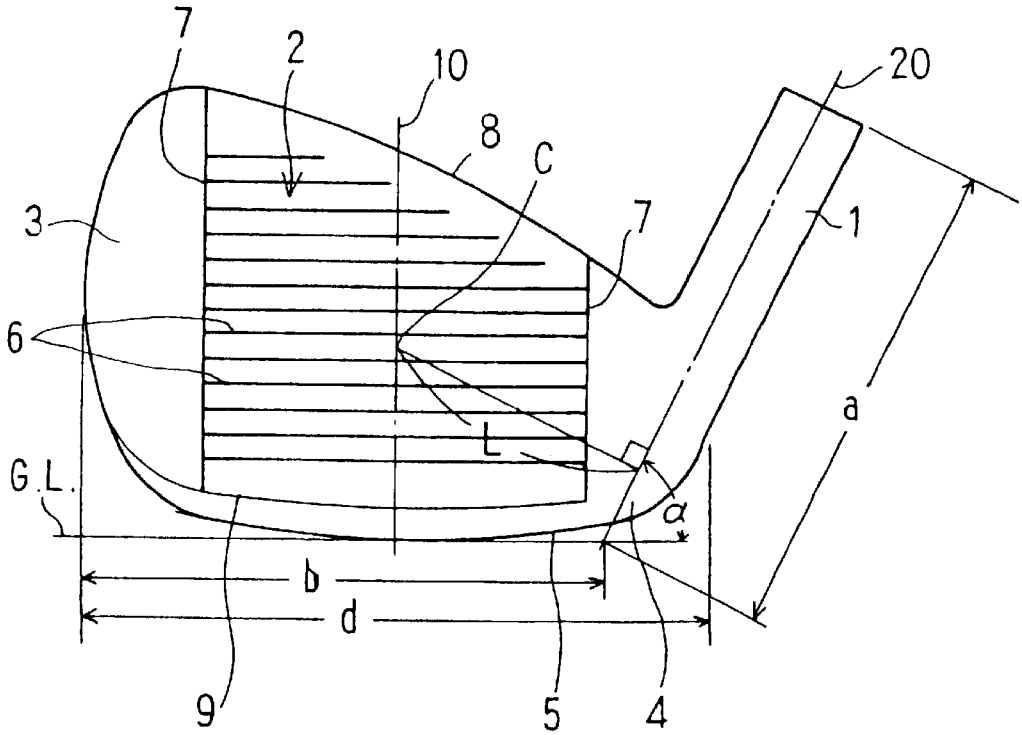
FIG. 16 is a front view of a sand iron club head according to the present invention.

FIG. 7 is a rear view of the No. 9 iron club head in FIG. 6, in which the rib width $t_2$ is further larger and $t_1$ is further smaller.

FIGS. 8 through 16 are front views of the iron club Nos. 2, 3, 6, 7, 8 and pitching wedge (PW), pitching sand iron (PS) and sand iron or wedge (SW), respectively, according to the present invention. For these iron clubs, the length a, b and d and lie angle $\alpha$ are as shown in Table 3. As seen from Table 3, the length d is 97.0 mm for all these iron clubs.

TABLE 3

| Club No. | 2 | 3 | 4 | 6 | 7 | 8 | PW | PS | SW |
|---|---|---|---|---|---|---|---|---|---|
| Lie angle α | 57 | 58 | 59 | 61 | 62 | 63 | 64 | 64 | 64 |
| Length a (mm) | 69.0 | 70.0 | 71.0 | 73.0 | 74.0 | 75.0 | 77.0 | 77.0 | 77.0 |
| Length b (mm) | 73.0 | 74.0 | 75.0 | 77.0 | 78.0 | 79.0 | 81.0 | 81.0 | 81.0 |
| Length d (mm) | 97.0 | 97.0 | 97.0 | 97.0 | 97.0 | 97.0 | 97.0 | 97.0 | 97.0 |

As seen from Table 3 and foregoing description, the length b in an iron club is substantially 1 mm greater than in a next-numbered iron club as the club number ascends and is same for all the three wedges.

According to the present invention, as the club number ascends, the center distance L between the axis of club shaft and the center of club head impact face is gradually longer and the distance between the club head gravity and the axis of club shaft is gradually longer with weight distributions. That is, as the club number ascends, the weight distributed on the heel side is gradually smaller while the weight distributed on the toe side is gradually larger. Namely, since the long irons have a short center distance, the inertia of moment about the shaft axis is so small that the club head face can be easily turned to the left after impact, resulting in less slice or push-out. On the contrary, as the short irons have a long center distance, the inertia of moment about the shaft axis is so large that the club head face can be delayed to turn to the left after impact, resulting in less pull.

What is claimed is:

1. A set of iron golf clubs, comprising:

a plurality of clubs, each of said plurality of clubs comprising a club shaft and a head, said head having a heel side and a toe side;

said plurality of clubs being configured such that as the club number ascends, a center distance between an axis of said club shaft and a center of a club head impact face is gradually longer;

said plurality of clubs further being configured such that as a club number for each of said plurality of clubs ascends, weight distributed on said heel side is gradually smaller while the weight distributed on said toe side is gradually larger, whereby both said center and a center of gravity for said head of each of said plurality of clubs are concomitantly located correspondingly larger distances from said axis of said club shaft as said club number for each of said plurality of clubs ascends;

said head for each of said plurality of clubs including structure defining a cavity in a back face thereof, a perimeter of said cavity being surrounded by a rib; and said plurality of clubs being configured such that as said club number ascends, a toe-side rib width of said rib is gradually larger while a heel-side rib width of said rib is gradually smaller.

2. A set of iron golf clubs according to claim 1, wherein a distance of said center of gravity from said axis of said club shaft is no greater than said center distance for each of said plurality of clubs irrespective of said club number.

3. A set of iron golf clubs according to claim 1, wherein a difference between said correspondingly larger distances of said center and said center of gravity from said axis of said club shaft are maintained at a substantially constant value for said head of each of said plurality of clubs irrespective of said club number.

4. A set of iron golf clubs according to claim 1, wherein;

each of said plurality of clubs further comprises a hosel extending upwardly from a portion of said heel side in substantial alignment with an axis of said club shaft; and a length measured along said shaft axis from a top of said hosel to a point of intersection with a ground line of said head being gradually shorter as said club number for each of said plurality of clubs descends.

5. A set of iron golf clubs, comprising:

a plurality of clubs, each of said plurality of clubs comprising a club shaft and a head, said head having a heel side and a toe side;

said head for each of said plurality of clubs including structure defining a cavity in a back face thereof, a perimeter of said cavity being surrounded by a rib;

said plurality of clubs being configured such that as the club number ascends, a center distance between an axis of said club shaft and a center of a club head impact face is respectively longer; and said plurality of clubs further being configured such that as a club number for each of said plurality of clubs ascends, a width of a toe-side portion of said rib is respectively larger while a width of a heel-side portion of said rib is gradually smaller, whereby weight distributed on the heel side is gradually smaller while the weight distributed on the toe side is gradually larger as said club number for each of said plurality of clubs ascends.

6. A set of iron golf clubs according to claim 5, wherein a distance between said axis of said club shaft and a center of gravity of said head of each of said plurality of clubs being smaller than said center distance.

7. A set of iron golf clubs according to claim 6, wherein said distance is about 3 mm smaller than said center distance.

8. A set of iron golf clubs according to claim 5, wherein;

each of said plurality of clubs further comprises a hosel extending upwardly from a portion of said heel side in substantial alignment with an axis of said club shaft; and a length measured along said shaft axis from a top of said hosel to a point of intersection with a ground line of said head being gradually shorter as said club number for each of said plurality of clubs descends.

9. A set of iron golf clubs comprising:

a plurality of clubs, each of said plurality of clubs comprising a club shaft and a head, said head having a heel side and a toe side;

said head for each of said plurality of clubs including structure defining a cavity in a back face thereof, a perimeter of said cavity being surrounded by a rib;

said plurality of clubs being configured such that as the club number ascends, a center distance between an axis of said club shaft and a center of a club head impact face is respectively longer;

said plurality of clubs further being configured such that as a club number for each of said plurality of clubs ascends, a width of a toe-side portion of said rib is respectively larger while a width of a heel-side portion of said rib is gradually smaller, whereby weight distributed on the heel side is gradually smaller while the weight distributed on the toe side is gradually larger as said club number for each of said plurality of clubs ascends; and a sum of said width of said toe-side portion and said width of said heel-side portion being substantially a constant value for each of said plurality of clubs.

* * * * *